US005697406A

United States Patent [19]

Trunek et al.

[11] Patent Number: 5,697,406

[45] Date of Patent: Dec. 16, 1997

[54] SYSTEM FOR DETECTING MISSING VENT TUBES ON A BOTTLE FILLING APPARATUS

[75] Inventors: Larry R. Trunek, Mukwonago; Richard R. Hanan, Pewaukee, both of Wis.

[73] Assignee: Miller Brewing Company, Milwaukee, Wis.

[21] Appl. No.: 678,801

[22] Filed: Jul. 12, 1996

[51] Int. Cl.[6] ..... B65B 1/04

[52] U.S. Cl. ..... 141/94; 141/144; 141/192

[58] Field of Search ..... 141/94, 129, 144, 141/192, 198; 137/551, 559; 222/52, 63; 340/603, 679, 680, 686

[56] References Cited

U.S. PATENT DOCUMENTS

| | | | |
|---|---|---|---|
| 2,322,228 | 6/1943 | De Staebler | 177/311 |
| 4,530,384 | 7/1985 | Boyes | 141/95 |
| 4,787,428 | 11/1988 | Bacroix et al. | 141/94 |
| 5,228,486 | 7/1993 | Henninger | 141/95 |

*Primary Examiner*—Henry J. Recla
*Assistant Examiner*—Steven O. Douglas
*Attorney, Agent, or Firm*—Quarles & Brady

[57] ABSTRACT

An apparatus for detecting the absence of a metal vent tube from a bottle filling machine comprises a nozzle that produces a stream of electrically conductive liquid which strikes the vent tube. A solenoid valve controls the flow of liquid to the nozzle and is activated by a control signal from the controller of the bottle filling machine. The apparatus also includes a generator which produces a signatured signal that is applied to the nozzle. A detector circuit has an input coupled to the frame of the bottle filling machine for detecting whether the signatured signal is present in the frame due to conduction from the vent tube. The detector responds to a failure to detect the signatured signal at the input by producing an output signal which indicates the absence of the vent tube. The controller responds to the detector output signal by shutting down the bottle filling machine until corrective action is taken.

15 Claims, 3 Drawing Sheets

SYSTEM FOR DETECTING MISSING VENT TUBES ON A BOTTLE FILLING APPARATUS

BACKGROUND OF THE INVENTION

This invention relates to machines for automatically filling a bottle, and more particularly to devices for detecting when a vent tube of such machines is missing.

Automatic equipment is commonly used to fill a bottle with a liquid, such as a beverage. The equipment has a fitting which couples to the mouth of the bottle and the liquid is introduced through the fitting into the bottle. A vent tube also extends into the bottle from the fitting to allow gas in the bottle to escape as the liquid is introduced. When the liquid reaches the bottom of the vent tube, the pathway for escaping gas is blocked by the rising liquid. With the gas path blocked, the liquid flow into the bottle stops because the gas and liquid are at the same pressure. The filling valve then is closed mechanically after a delay period. Next the fitting is removed from the mouth of the bottle and a conveyor carries the filled bottle to a station in which a lid or a cap is applied to the open mouth.

The vent tube typically is made of metal or plastic and is held in a friction fit within a coupling of the automatic filling machine. This removability allows the use of vent tubes of different lengths to fill various size bottles. However, the vent tube occasionally dislodges from the fitting and falls downward either onto the filling machine or into a bottle. Although snap and screw fittings alternatively have been used to attach the vent tube, even these fittings may loosen allowing the vent tube to fall off. Because the vent tube is essential to the proper filling of the bottles, a missing vent tube must be detected and the bottling line shut down until the vent tube is replaced into the fitting. In addition, when a vent tube comes falls off, recently filled bottles may have to be inspected to determine if the missing vent tube fell into one of them, in which case the bottle containing the vent tube must removed from the bottling line.

SUMMARY OF THE INVENTION

The general object of the present invention is to provide a mechanism for detecting when a component, such as a vent tube, is missing from an automatic bottle filling machine.

Another object is to provide a detection mechanism which does not contact the component in a manner which may cause the component to come loose.

A further object of the present invention is to provide such a mechanism that does not adversely affect the speed at which the bottle filling machine operates.

These and other objectives are fulfilled by a detection apparatus which includes a nozzle that produces a stream of an electrically conductive fluid, such as water, which strikes the component. The nozzle may be coupled to a control valve so that the stream can be selectively formed. A generator produces an electrical signal having a characteristic or signature which allows that signatured signal to be distinguished from other signals in the environment of the bottle filling machine. For example, that signature may be a specific frequency or modulation pattern. This signatured signal is applied to the nozzle from which the signal is carried by the stream of conductive fluid to the component and through the component to other elements of the machine. If the component is absent, the fluid stream does not contact the machine in a manner in which the signatured signal is conducted to machine elements.

A detector circuit has an input coupled to the machine in order to detect the existence of the signatured signal being conducted by elements of the machine. The presence or absence of the signatured signal in the machine elements respectively indicates the presence or absence of the component to which the fluid stream is to strike. Preferably, the detector selectively responds only to the particular signatured signal applied to the nozzle so that ambient electrical signals from the environment of the machine do not produce a false indication that the component is present when in fact the component is missing.

DETAILED DESCRIPTION OF THE INVENTION

An automatic bottle filling machine typically has a number of filling stations mounted on a rotating mechanism. Bottles to be filled with a liquid by the filling station pass in a circular path on a conveyor beneath the plurality of filling stations. The filling stations rotate in unison with the bottles and each filling station introduces the liquid into the bottle thereunder. Such automatic filling machines frequently are used to fill bottles with soda and beer.

Figure 1:
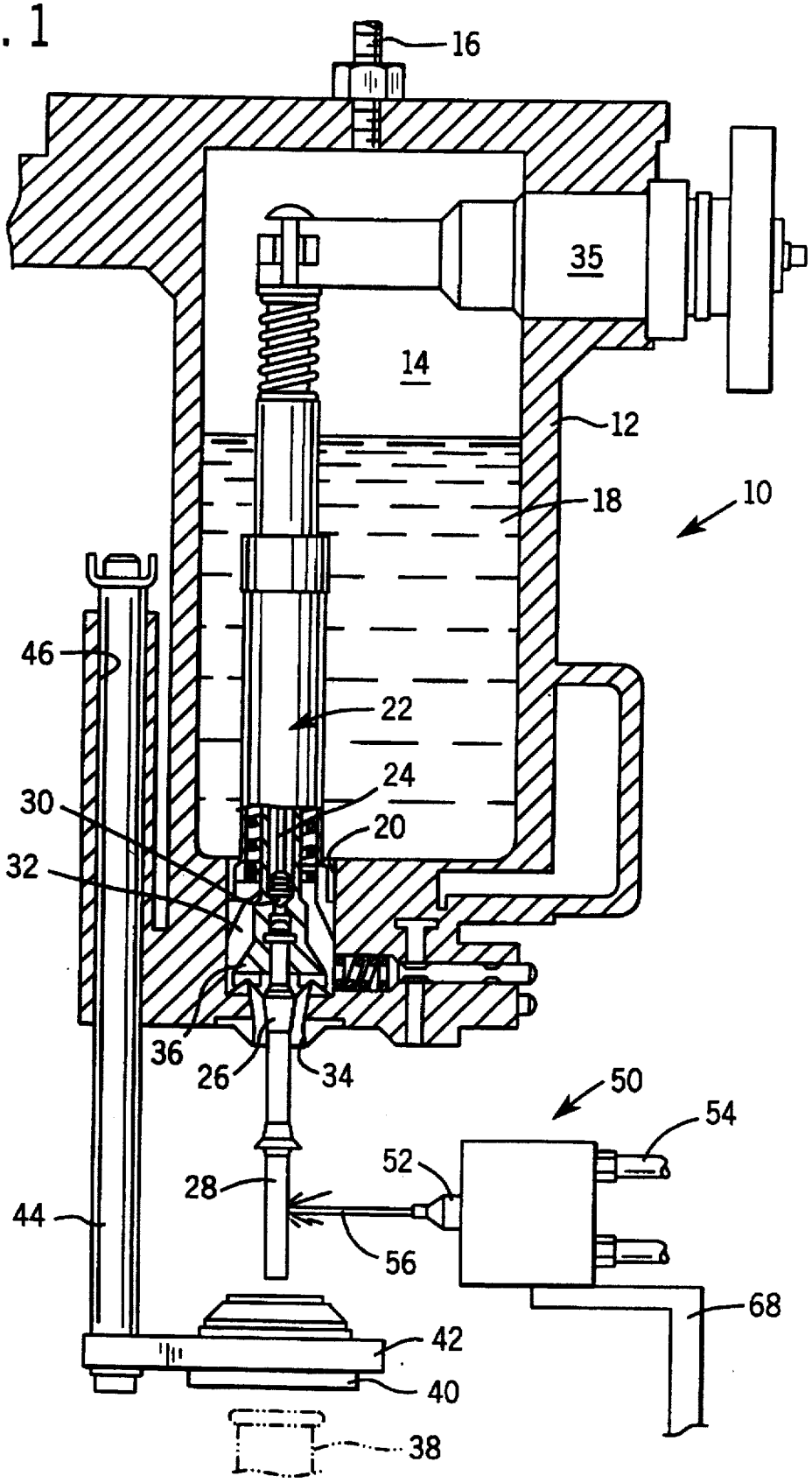
FIG. 1 is a partial cross-sectional view of an machine for automatically filling a bottle, which machine is in a state between filling operations.

Referring initially to FIG. 1, each filling station 10 has a housing 12 which defines a reservoir 14 that contains a supply of the beverage to be injected into the bottles. The reservoir 14 is fed with the beverage via a tube 16 and holds a quantity of beverage 18 which is greater in volume than that of the bottle to be filled. The bottom of housing 12 has a reservoir outlet 20 within which a valve assembly 22 is located.

The valve assembly 22 includes a central tube 24 connected at fitting 26 to a metal or plastic vent tube 28 that projects downward from the filling station 10. The combination of tubes 24 and 28 provides a passage through which air in a bottle being filled escapes into the upper portion of the reservoir 14, as will be described. A valve 30 is in this passage between the inner tube 24 and fitting 26. A beverage flow passage 32 exists between the valve assembly 22 and the side walls of the reservoir outlet 20. A second valve 36 is located in the beverage passage 32 at an outlet nozzle 34 which when closed blocks the flow of beverage from the reservoir 14. The two valves 30 and 36 are operated by an actuator 35 which is driven by a cam (not shown) which the filling station 10 encounters during rotation about the automatic filling machine. The filling station 10 described thus far is of a conventional design that commonly is used to fill bottles with various types of beverages.

Figure 2:
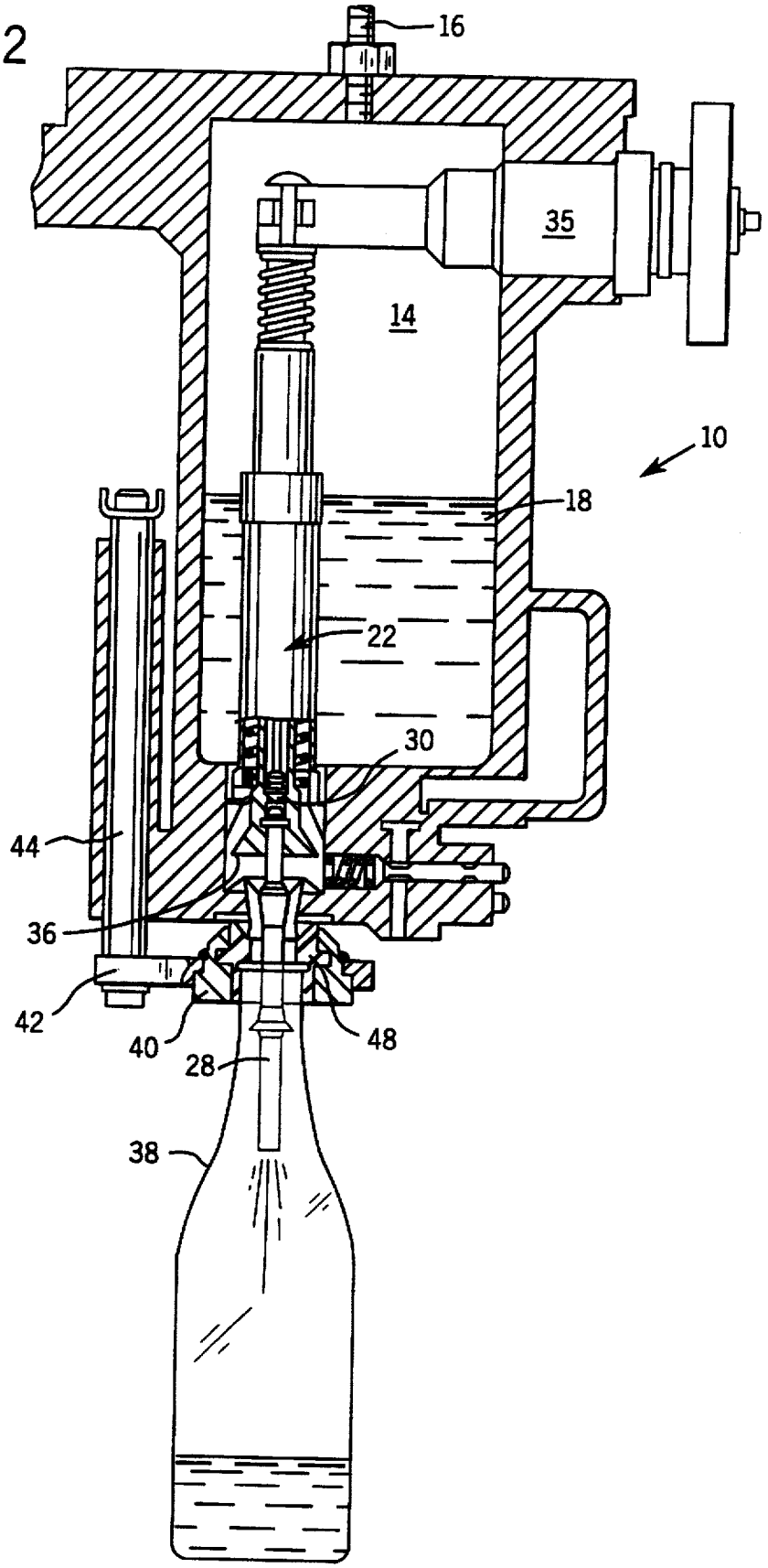
FIG. 2 is a cross-sectional view of the automatic bottle filling machine during the filling operation.

A bottle 38 to be filled is positioned beneath an annular centering tulip 40 located below the vent tube 28 on an arm 42 that is coupled to a vertical rod 44 which slides within an aperture 46 of the housing 12. As the bottle 38 and the filling station 10 move together along the bottling line, an elevator (not shown) raises the bottle upward so that the bottle mouth contacts the centering tulip 40. Continuing elevation of the bottle 38 pushes the tulip 40, arm 42 and rod 44 upward with respect to the housing 12, causing the vent tube 28 to enter the cavity of the bottle. When the rising components reach the upper limit of their travel shown in FIG. 2, the mouth of the bottle 38 is pushed into a bottle seal 48 within the centering tulip 40 and the bottle seal engages the lower lip of the outlet nozzle 34. The bottle seal 48 provides a fluid tight coupling between the outlet nozzle 34 and the mouth of the bottle 38.

Thereafter, the actuator 35 operates the valve assembly 22 to open air outlet valve 30 and beverage passage valve 36. This action causes beverage 18 within reservoir 14 to flow through the outlet passage and into the bottle. As this is occurring, air within the bottle, that is being displaced by the incoming beverage, flows through the vent tube 28 into the reservoir 14 from the upper portion of the valve assembly 22. At the same time, additional beverage is introduced into the reservoir 14 through the inlet tube 16 and the air within the reservoir is able to escape through a housing aperture (not shown).

When the beverage in the bottle reaches the lower end of the vent tube 28, the path by which air is able to escape the bottle is blocked creating a positive pressure that prevents further beverage to flow into the bottle. Once this takes place, the actuator 35 closes the air outlet valve 30 and the beverage passage valve 36 preventing further filling of the bottle. Next the elevator (not shown) lowers the bottle 38 causing the tulip 40, mounting arm 42 and rod 44 to drop downward by gravity following the downward motion of the bottle. Eventually the rod 44 reaches the lower limit of its travel at which point further lowering by the elevator causes the filled bottle to come free of the bottle seal 48 within the tulip 40. Now the apparatus has returned to the position shown in FIG. 1.

As mentioned previously, one of the problems with this type of automatic filling machinery is that the vent tube 28 which is held within the fitting 26 can work loose over repetitive filling operations. Thus the vent tube 28 can drop onto the machinery or into one of the bottles 38 being filled. To detect the absence of the vent tube 28, the filling station 10, between filling operations, rotates past a presence sensing mechanism 50 mounted on the frame 68 of the bottle filling machine.

The presence sensing mechanism 50 includes a nozzle 52 which is fed with a conductive liquid, such as water, from a supply tube 54. When activated, the conductive liquid flows from the nozzle 52 in a stream 56 which impinges the vent tube 28. This action occurs between filling operations when the vent tube 28 is not inserted into a bottle. The force of the fluid stream is relatively small so that the vent tube is not dislodged from the fitting. On the other hand, if the vent tube 28 is missing, the stream 56 of conductive liquid flows past the filling station 10 dispersing into a wide spray.

Figure 3:
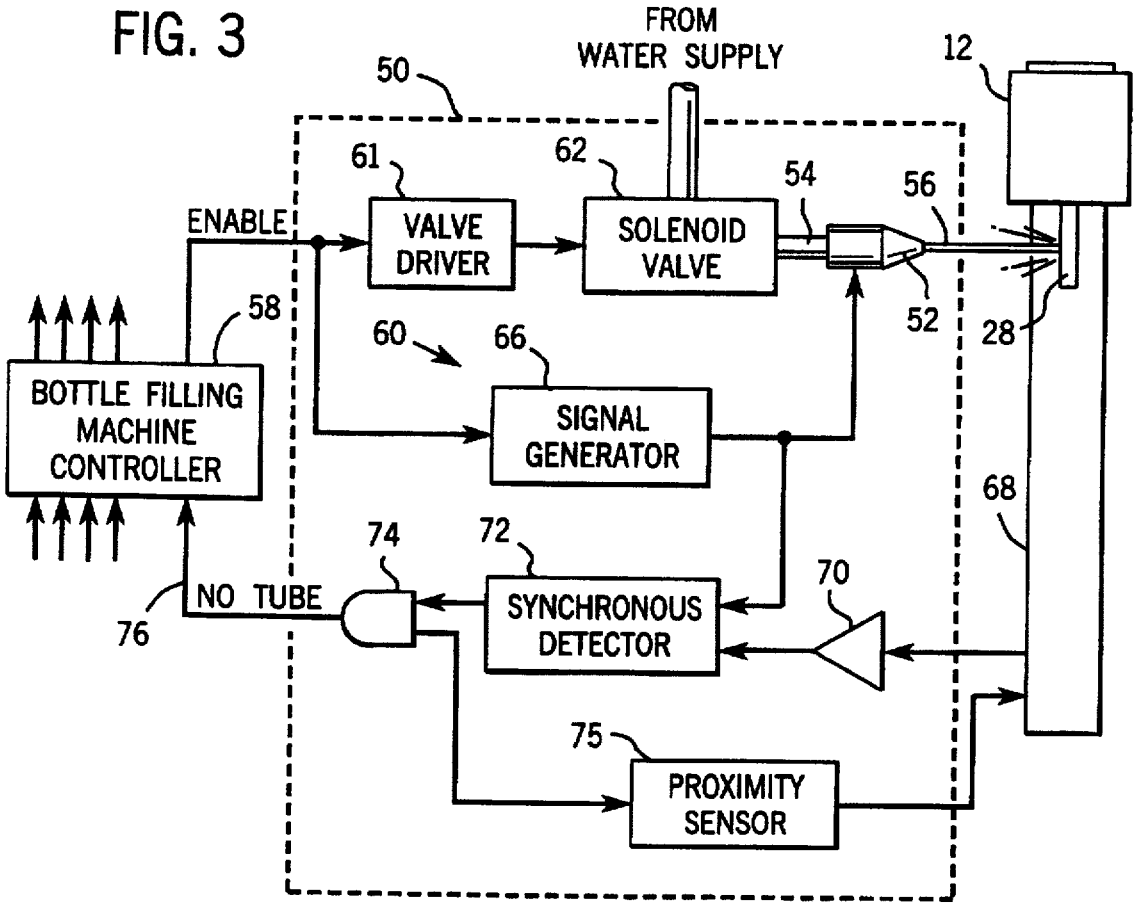
FIG. 3 is a block diagram of a mechanism for detecting the absence of a vent tube of the bottle filling machine.

The presence, or more correctly the absence, of a vent tube 28 is sensed electrically by the circuit 60 shown in FIG. 3. When the bottle filling machine is active, its controller 58 activates a valve driver 61 which opens a solenoid valve 62 so that conductive liquid flows from a supply to nozzle 52 via tube 54. This action produces the fluid stream 56.

At the same time, a signal generator 66 is enabled and produces a high frequency output signal which is applied to the nozzle 52. The frequency is selected to be distinct from other electrical signals that may be present in the bottling plant, which ambient signals could be induced into components of the bottle filling machine and result in false presence sensing. Alternatively, the output signal could be modulated with predefined information or provided with another characteristic so as to be distinguishable from the ambient signals. As used herein the term "signatured signal" refers to a signal that has a characteristic which enables that signal to be distinguished from other electrical signals in the environment of the bottle filling machine which other signals would otherwise adversely affect the detection of a missing vent tube by the mechanism 50.

The signatured signal from generator 66 is carried by the conductive liquid stream 56 to the vent tube 28 from which the signal is conducted through the metal filling station housing 12 and the metal frame 68 of the automatic bottle filling machine. The signal is conducted through the conductive liquid which coats the outside of the vent tube providing an electrical path to the housing 12 even when a plastic vent tube 28 is used. The body of a metal vent tube 28 also provides this conductive path to the housing 12.

If the vent tube 28 is missing, the stream of conductive liquid 56 flows past the filling station 10 dispersing into a wide spray which does not provide a conductive path for the signal from generator 66 to travel between the nozzle 52 and the bottle filling machine.

Referring still to FIG. 3, the frame 68 is electrically connected to an input of a preamplifier 70 which produces an output signal that is connected to one input of a synchronous detector 72. Another input of the synchronous detector 72 receives the signatured signal from the signal generator 66. The synchronous detector 72 determines whether the signal from the preamplifier 70 contains the signatured signal produced by generator 66. This may be accomplished by comparing the frequencies or phases of the two signals, or by other methods known in the art. As a result, synchronous detector 72 senses when the signal from generator 66 is present at the input of the preamplifier 70 as occurs when the stream of conductive liquid 56 is impinging upon the vent tube 28. The synchronous detector 72 produces a high output signal whenever the signal from generator 66 is not present in the output of preamplifier 70, as occurs when the vent tube 28 is missing. The output signal from the synchronous detector 72 is applied to an input of an AND gate 74.

If the signatured signal utilizes a characteristic other than frequency to be distinguishable from other signals in the environment, then the synchronous detector 72 would be replaced by a component that detects that characteristic signal in the output of preamplifier 70. For example, if the signal generator 66 modulates a carrier with a predefined data sequence, then the synchronous detector 72 would be replaced with a circuit that detects the predefined data sequence being received from the preamplifier 70.

The circuit 60 also includes a non-contacting proximity sensor 75 which detects when one of the beverage filling stations 10 has rotated into a position adjacent to the presence sensing mechanism 50. When that occurs, the proximity sensor 75 produces a high logic level signal that is applied to the other input of AND gate 74. If the signals from the synchronous detector 72 and the proximity sensor 75 are both at a high logic level, the presence sensing mechanism 50 produces an active high level warning signal, designated "NO TUBE", which is applied to an input 76 of the bottle filling machine controller 58. Because the synchronous detector 72 also produces a high output signal when one of the filling stations 10 is not adjacent the presence sensing mechanism 50 on frame 68 of the bottle filling machine, the AND gate 74 prohibits an active NO TUBE signal from being sent to the controller 58 at those times as the output signal from the proximity sensor 75 is false.

Alternatively, rather that having the conductive liquid flow continuously from the nozzle 28, the solenoid valve 62 could be controlled by the proximity sensor 75 or controller 58 responding to the proximity sensor output signal, so that a liquid stream 56 is formed only when a filling station 10 is near the nozzle. However, the use of a continuous stream 56 allows the bottle filling machine to operate at maximum speed.

Controller 58 responds to an active NO TUBE signal by emitting a warning indication to the operator of the bottling line. The NOT TUBE signal also may be used to shut down the bottle filling machine until the operator cures the problem which caused the shut down, such as by replacing a missing vent tube, and resets the system to once again commence filling operation.

The foregoing description is directed primarily to preferred embodiments of the invention. Although some attention was given to various alternatives within the scope of the invention, it is anticipated that skilled artisans will likely realize additional alternatives that are now apparent from the disclosure of those embodiments. Accordingly, the scope of the invention should be determined from the following claims and not limited by the above disclosure.

We claim:

1. An apparatus for detecting presence and absence of a component of a bottle filling machine, said apparatus comprises:

a nozzle to produce a stream of an electrically conductive fluid which strikes the component;

a generator that produces a signatured signal at an output which is coupled to said nozzle; and a detector circuit having an input adapted to be coupled to the bottle filling machine for detecting the signatured signal being conducted by the bottle filling machine and in response thereto producing an output signal which indicates at least one of the presence and absence of the component.

2. The apparatus as recited in claim 1 wherein said detector circuit comprises a synchronous detector having a first input at which the signatured signal from said generator is received and a second input coupled to the bottle filling machine, the synchronous detector producing the output signal in response to detecting the signatured signal at the second input.

3. The apparatus as recited in claim 1 wherein the electrically conductive fluid is water.

4. The apparatus as recited in claim 1 wherein the component is a vent tube fabricated of an electrically conductive material.

5. The apparatus as recited in claim 1 wherein the signatured signal is modulated.

6. The apparatus as recited in claim 1 wherein the signatured signal carries a predefined data sequence.

7. The apparatus as recited in claim 1 further comprising a valve connected to said nozzle to control the flow of the electrically conductive fluid to said nozzle.

8. An apparatus for controlling a bottle filling machine in response to detecting the presence and absence of a vent tube, said apparatus comprising:

a nozzle to produce a stream of water which strikes the vent tube;

a generator which produces a signatured electrical signal at an output which is coupled to said nozzle;

a detector circuit having an input adapted to be coupled to the bottle filling machine for detecting the signatured electrical signal and in response thereto producing an output signal which indicates at least one of the presence and absence of the vent tube; and a controller which responds to the output signal from said detector circuit by terminating bottle filling by the bottle filling machine.

9. The apparatus as recited in claim 8 wherein the vent tube is fabricated of an electrically conductive material.

10. The apparatus as recited in claim 8 wherein the signatured signal carries a predefined data sequence.

11. The apparatus as recited in claim 8 wherein said detector circuit comprises a synchronous detector having a first input at which the signatured electrical signal from said generator is received and a second input coupled to the bottle filling machine, the synchronous detector producing the output signal in response to detecting the signatured signal at the second input.

12. The apparatus as recited in claim 8 wherein the vent tube is part of a bottle filling Station which moves with respect to other components of the bottle filling machine, said apparatus further comprising a proximity sensor to detect presence of the bottle filling station adjacent to the nozzle.

13. A method for controlling a bottle filling machine, wherein said method comprises:

directing a stream of an electrically conductive fluid from a nozzle toward a component of the bottle filling machine;

producing a signatured electrical signal which is applied to the nozzle;

detecting the signatured electrical signal being conducted in the bottle filling machine;

producing an output signal, which indicates the component is missing, in response to the detecting step failing to detect the signatured electrical signal; and responding to the output signal by terminating bottle filling.

14. The method as recited in claim 13 wherein the producing a signatured electrical signal comprises generating a signal having a signal having a predefined frequency; and wherein detecting the signatured electrical signal comprises detecting presence of a signal having the predefined frequency.

15. The method as recited in claim 13 wherein the producing a signatured electrical signal comprises generating a signal which carries predefined data; and wherein detecting the signatured electrical signal comprises detecting presence of a signal carrying the predefined data.

* * * * *